US006637695B2

(12) United States Patent
Oehrl et al.

(10) Patent No.: US 6,637,695 B2
(45) Date of Patent: Oct. 28, 2003

(54) METHOD OF WINDING A TRAVELING YARN AT A WORK STATION OF A SPINNING BOBBIN WINDING MACHINE OR OF A BOBBIN WINDING MACHINE

(75) Inventors: Wilhelm Oehrl, Erkelenz (DE); Bert Hurtz, Mönchengladbach (DE); Wolfgang Dörner, Mönchengladbach (DE); Gudrun Doss, Wegberg (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 10/017,550

(22) Filed: Dec. 14, 2001

(65) Prior Publication Data

US 2002/0074445 A1 Jun. 20, 2002

(30) Foreign Application Priority Data

Dec. 14, 2000 (DE) ..... 100 62 479

(51) Int. Cl.[7] ..... B65H 54/22; B65H 67/08; B65H 69/00

(52) U.S. Cl. ..... 242/475.5; 242/475.6

(58) Field of Search ..... 242/475.1, 475.4, 242/475.5, 475.6; 57/264, 22, 23

(56) References Cited

U.S. PATENT DOCUMENTS

| | | | | | |
|---|---|---|---|---|---|
| 4,513,921 | A | * | 4/1985 | Imoda et al. | 242/475.1 |
| 4,666,096 | A | | 5/1987 | Heel et al. | 242/486.7 |
| 4,817,425 | A | * | 4/1989 | Ueda et al. | 57/264 X |
| 4,920,739 | A | | 5/1990 | Raasch | 57/263 |
| 5,531,391 | A | * | 7/1996 | Yamamoto | 242/475.1 |
| 5,862,660 | A | | 1/1999 | Haasen et al. | 57/22 |
| 2002/0023982 | A1 | * | 2/2002 | Kargel et al. | 242/475.5 |

FOREIGN PATENT DOCUMENTS

| | | | |
|---|---|---|---|
| DE | 26 02 235 | A1 | 8/1977 |
| DE | 32 40 486 | A1 | 6/1983 |
| DE | 34 38 962 | A1 | 5/1987 |
| DE | 38 01 964 | A1 | 7/1989 |
| DE | 39 11 505 | A1 | 10/1990 |
| DE | 196 40 184 | A1 | 4/1998 |
| DE | 100 20 665 | A1 | 10/2001 |
| EP | 0 628 509 | B1 | 10/1996 |
| JP | 05 330740 | | 12/1993 |

OTHER PUBLICATIONS

European Search Report.

Patent Abstract of Japan 05 330 740 A1 Dec. 1993.

Publication H. Schwartz Entitled: Qualitätskontrolle durch Knotenzählung (Translation—Quality Control by Knot Counting) Apr. 1968.

German Search Report.

* cited by examiner

*Primary Examiner*—Kathy Matecki
*Assistant Examiner*—Evan Langdon
(74) *Attorney, Agent, or Firm*—Kennedy Covington Lobdell & Hickman, LLP

(57) ABSTRACT

A method of winding the yarn traveling at a work station of a spinning bobbin winding machine or of a bobbin winding machine from a yarn source onto a take-up bobbin (4). After each yarn interruption, the yarn end is unwound from the take-up bobbin (4), a yarn joinder reconnects the yarn source and the take-up bobbin (4) and the winding process is then continued if a tolerable yarn joining location is present. Upon the occurrence of each yarn interruption, the amount of yarn wound since the last yarn joinder is determined. If such amount of yarn is determined to be less than a predetermined amount of yarn, a sufficient amount of yarn is unwound and separated from the take-up bobbin (4) to include the last-occurring yarn joining location in the separated yarn section. This results in an optical improvement in the quality of the finished textile product.

5 Claims, 2 Drawing Sheets

METHOD OF WINDING A TRAVELING YARN AT A WORK STATION OF A SPINNING BOBBIN WINDING MACHINE OR OF A BOBBIN WINDING MACHINE

CROSS-REFERENCES TO RELATED APPLICATIONS

This application claims the benefit of German patent application DE P 10062479.0 filed Dec. 14, 2000, herein incorporated by reference.

BACKGROUND OF THE INVENTION

The present invention relates to a method of winding a traveling yarn at a work station of a yarn winding machine, such as a spinning bobbin winding machine or a bobbin winding machine.

German Patent Publication DE 38 01 964 A1 teaches a method and a device for restoring the spinning operation at an OE (open end) spinning station after an interruption. The spun yarn is wound at the particular spinning station onto a take-up bobbin in the form of a cheese. An autonomous, movable yarn joining or piecing unit is delivered to the spinning station upon a yarn interruption during the bobbin winding operation, that is, between the start of the winding of a yarn end onto an empty tube and the finishing of the cheese, as well as upon a bobbin replacement. In order to eliminate a yarn break, the yarn end is automatically drawn back from the take-up bobbin being formed as a cheese after a first joining program of the joining unit, delivered to the spinning element of the spinning station, placed on the spinning fibers present thereat or fed thereto and is then continuously drawn off from the spinning element as a rejoined yarn, transferred to the spinning station and wound onto the cheese.

German Patent Publication DE 196 40 184 A1 describes a method for cleaning yarn defects or flaws at a winding head of a bobbin winding machine. Yarn defects detected by a sensor are completely cleaned with this method whether they are long or short yarn defects. To this end, the length of the yarn with a defect is determined after the occurrence of a yarn defect between the time of the occurrence of the defect and the time of the yarn cut. A suction tube is positioned in front of the take-up bobbin in order to remove the yarn pieces with defects. The yarn end is unwound, the entrance of the yarn determined by a sensor located in the suction tube and the yarn length unwound from the take-up bobbin and traveling into the suction tube determined. The unwinding process is stopped when a sufficient yarn length has been drawn into the suction tube on the basis of the determined yarn length that, during the subsequent placing of the yarn drawn from the take-up bobbin into the yarn-end joining device, the yarn length which was wound onto the take-up bobbin subsequent to the occurrence of the yarn defect remains outside of the yarn-end joining device for separation.

Yarn joining locations that can be present in the form of knots, splices or other forms of yarn end joinders are practically unavoidable after yarn interruptions during the winding process and during the bobbin winding operation. It is disadvantageous for economic reasons to unwind the entire yarn previously wound onto the tube after a cleaning step and to draw it off as waste in order not to have to accept any yarn joining locations in the yarn. The production of relatively large-volume cheeses from several spinning cops is not possible at all without yarn joining locations. Since a yarn joining location must necessarily be generated to join the yarn end drawn off from the already wound yarn of the bobbin being formed into a cheese to the yarn source, e.g., a spinning station or element, the yarn joining locations are tolerated in the finished yarn on account of this unavoidable state of affairs even though they constitute imperfections. The imperfection can consist on the one hand in a deviation in thickness of the yarn caused by the yarn joining location. A check for joined-yarn locations is customary in spinning bobbin winding machines during which the thickness of the joined yarn and thick or thin areas in the yarn directly in front of or behind the joined yarn are detected. Such joined yarns that do not meet a given quality criteria can be immediately eliminated with the joined-yarn check and subsequently replaced by a yam joinder that meets these quality criteria. On the other hand, imperfections of color can also occur. For example, a change of the color absorption behavior can occur in a splicing station during the splicing of yarns containing synthetic fibers due to hot air. This change of color absorption behavior can make itself noticeable in a disadvantageous manner during the dyeing process.

In general, a sporadic occurrence of yarn joining locations in a finished textile product, e.g., a fabric, is not important. However, it can occur that two or more yarn joining locations follow each other relatively closely in the yarn. A defect that can hardly be recognized with the naked eye but is nevertheless undesirable or even has the effect of reducing the value can be present due to repeated occurrences in the finished textile product. Such defects can not be excluded when using the known methods and must therefore be accepted.

SUMMARY OF THE INVENTION

It is accordingly an object of the present invention to provide an improved method of winding a traveling yarn at a work station of a yarn winding machine, such as a spinning bobbin winding machine or of a bobbin winding machine, which will improve the quality of the winding of a take-up bobbin.

Briefly summarized, the present invention reliably avoids an undesirable accumulation of yarn joining locations that form a recognizable defect in the finished product by determining, upon the occurrence of a yarn interruption, the amount of yarn wound since the last yarn joinder and, if this amount of yarn is less than a predetermined amount, such an amount of yam is unwound from the take-up bobbin and the unwound yarn end is removed such that the preceding yarn joining location is in the removed yarn section.

Whether or not the predetermined yarn amount has been met can be determined in an especially rapid and simple manner if the time elapsed since the restart of the winding process after the last yarn joinder is determined as a measure for the wound amount of yarn and a time span is set as the predetermined criterion. The yarn length corresponding to the amount of yarn wound onto the take-up bobbin is determined, this yarn length is unwound off the take-up bobbin and the unwound yarn end is separated and removed. By also removing a predetermined yarn length in addition to the determined yarn length, it is assured that the previous yarn joining location is in the separated yarn section. The removal of the separated yarn end can take place in a customary manner by suction removal.

As an advantageous alternative, the yarn length wound onto the take-up bobbin since the preceding restart of the winding process after the last yarn joinder is immediately determined as a measure for the wound amount of yarn and a length is set as the predetermined amount. If the predetermined yarn length set as the criterion is not achieved, the determined length of wound yarn can be used immediately without further recalculation as the length that is to be unwound again.

The method of the invention can be used advantageously in spinning bobbin winding machines in which the spinning unit or the spin box is the yarn source and in winding machines in which a feeding bobbin functions as yarn source.

It is possible with the method of the invention to achieve an effective improvement of quality in a simple manner in the finished yarn as well as also in particular in the finished textile product in which the yarn has been processed.

Further details, features and advantages of the invention will be explained in and understood from the following description with reference to the accompanying drawings.

DESCRIPTION OF THE PREFERRED EMBODIMENT

Figure 1:
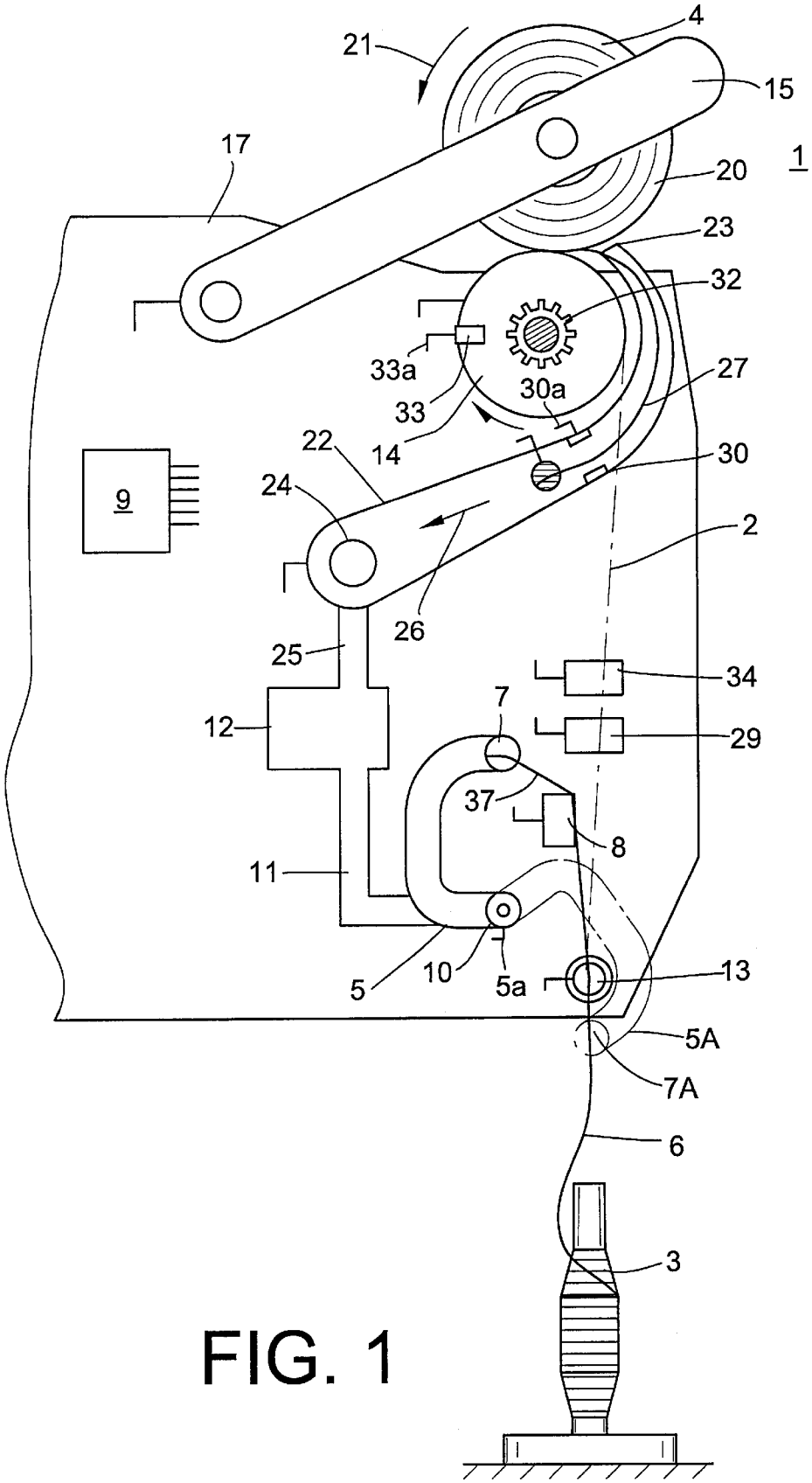
FIG. 1 is a simplified schematic side elevational view depicting the practice of the method of the present invention in a work station in a bobbin winding machine.

Referring now to the accompanying drawings and initially to FIG. 1, a work station in a bobbin winding machine is shown wherein the course of the yarn 2 between feeding bobbin 3 and take-up bobbin 4 has been interrupted at winding head 1 after a yarn cut on account of a yarn defect detected by cleaner 29. The yarn interruption is carried out by cutting device 34. The path of travel of yarn 2 assumed during the normal winding operation has therefore been shown in a broken line. Take-up bobbin 4 is rotatably carried by bobbin holder 15 pivotably supported on machine frame 17. Yarn gripper tube 5 has caught the lower yarn 6 being unwound from feeding bobbin 3 via suction opening 7 and placed it into a yarn-end joining device, in this case designed as splicing device 8. To this end a drive (not shown for the sake of simplicity) has been activated by control device 9 via lead 5*a*. The drive has pivoted yarn gripper tube 5 out of its initial position 5A shown in broken lines, in which suction opening 7 for catching the lower yarn 6 is in position 7A in the path of travel of yarn 2, into the position shown in FIG. 1. Swivel joint 10, about which yarn gripper tube 5 can be pivoted, is designed as a connection to vacuum line 11 that empties into suction conduit 12. Suction conduit 12 is connected to a central vacuum source of the bobbin winding machine. The lower yarn 6 held by suction opening 7 of yarn gripper tube 5 runs in the position shown initially through open yarn tensioner 13 and then through splicing device 8.

A predetermined yarn length value is stored in control device 9. The predetermined yarn length value can be freely selected, taking into consideration the particular quality requirements for the yarn. Control device 9 compares this stored length with the yarn length that had been wound onto take-up bobbin 4 since the restart of the winding process after the last yarn joinder. In order to detect the yarn length wound onto take-up bobbin 4 the impulses are counted that are generated by sensor 33 and caused by the rotation of cogwheel 32. The impulses are fed via lead 33*a* to control device 9. Control device 9 determines from these impulses the yarn length wound since the last yarn joinder and compares this yarn length with the stored length.

If the yarn length wound onto the take-up bobbin since the last yarn joinder is greater than the stored predetermined length, the removal of the yarn defect that caused the yarn interruption and the re-joinder of the yarn is performed or continued, for example in the manner described in German Patent Publication DE 196 40 184 A1.

On the other hand, if the yarn length wound onto the take-up bobbin since the last yarn joinder is less than the stored predetermined length, take-up bobbin 4 is driven in reverse in accordance with the present invention by friction roller 14 in an unwinding direction 21 until the last-occurring yarn joining location 38 has been unwound from the yarn body of take-up bobbin 4.

To this end, mouth 23 of suction tube 22 is positioned in front of the circumferential surface 20 of take-up bobbin 4. Suction tube 22 also communicates via swivel joint 24 and line 25 with suction conduit 12. A valve (not shown) is regulated by control device 9 and suction tube 22 is loaded with a suction current. The suction current is indicated by arrow 26. Yarn end 27 lying on circumferential surface 20 is drawn into suction tube 22 by suction and the unwinding process carried out in the manner in accordance with the present invention. If the unwound yarn end 27 has reached a length that is as long as the yarn length wound since the restart of the winding process after the last-occurring yarn joinder 38 or is longer than the latter by a predetermined amount, the unwinding of yarn end 27 is stopped. The predetermined amount added to the set length increases the reliability that the last-occurring yarn joinder 38 is in the separated yarn section. Yarn end 27 can be clamped in suction tube 22 by clamping device 30 before suction tube 22 pivots back into the initial position shown in FIG. 2, thereby placing the yarn into splicing device 8.

Figure 2:
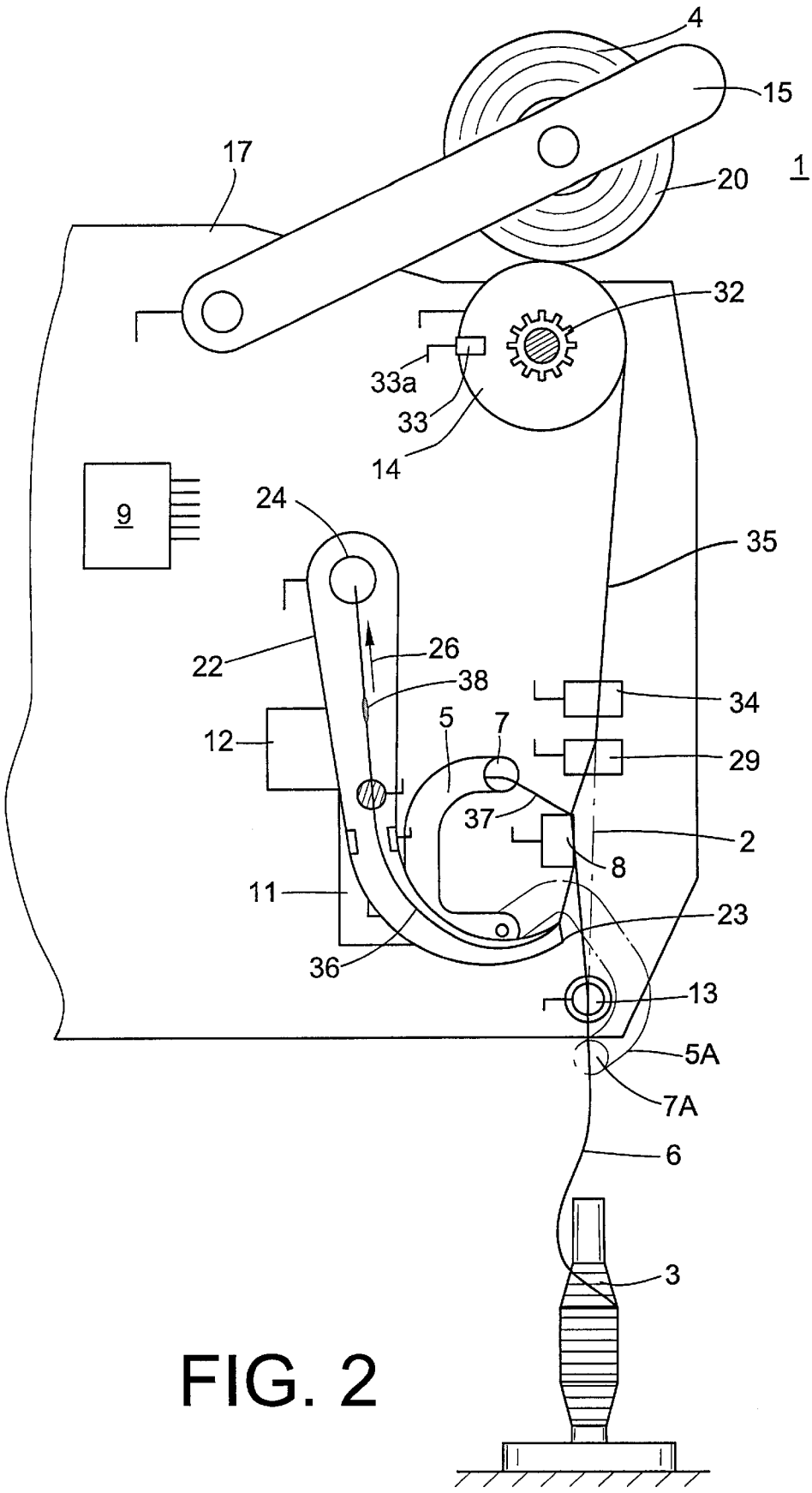
FIG. 2 is another simplified schematic side elevational view depicting the work station of the bobbin winding machine of FIG. 1 with the yarn placed in a splicing device.

FIG. 2 shows suction tube 22 returned into its initial position. Yarn 35 unwound from take-up bobbin 4 has been placed into splicing device 8. Yarn joining location 38 in yarn 36 is thereby positioned above splicing device 8, as viewed in the direction of yarn travel, and in no case below splicing device 8 in yarn 35. In order to prepare the joining of lower yarn 6 and of yarn 35, the yarn sections or the particular yarn ends extending beyond splicing device 8 are separated. Yarn 36 is removed by suction after the separation via suction tube 22. Yarn section 37 extending into yarn gripper tube 5 is removed after the separation in yarn gripper tube 5. The joinder of the yarn ends formed by the separations takes place in the embodiment shown by pneumatic splicing. After the yarn joinder between the yarn from feeding bobbin 3 and the yarn from take-up bobbin 4 is successfully reestablished by splicing, the winding process is continued again.

In an alternative embodiment (not shown), the method of the present invention is used at the work station of a spinning bobbin winding machine. The spinning bobbin winding machine can be, e.g., the type known from German Patent Publication DE 38 01 964 A1. The yarn source is formed by a spinning unit, such as a so-called spin box, and the spun yarn wound onto a take-up bobbin. The yarn joining takes place thereby by means of a joining or piecing process. The yarn joining location formed in this manner is designated as a joined yarn.

Further information and explanations can be gained from German Patent Publication DE 38 01 964 A1 or the associated U.S. Pat. No. 4,920,739 and from German Patent Publication DE 196 40 184 A1 or the associated U.S. Pat. No. 5,862,660.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of winding a yarn traveling at a work station of a yarn winding machine from a yarn source to a take-up bobbin onto which the yarn is wound, comprising the steps of:

a minimum criterion is predetermined for an amount of yarn to be wound onto the take-up bobbin between successive yarn joinders, after a yarn interruption, an amount is determined for the yarn wound onto the take-up bobbin since a preceding yarn joinder, after the yarn interruption, a yarn end from the take-up bobbin is unwound therefrom, if the amount determined for the yarn wound onto the take-up bobbin since the preceding yarn joinder is less than the amount of the predetermined criterion, the length of yarn unwound from the take-up bobbin is sufficient to include the preceding yarn joinder and the unwound length of yarn is separated and removed, a yarn joinder is formed between a yarn end from the yarn source and the yarn end from the take-up bobbin, and winding of the yarn from the yarn source onto the take-up bobbin is then continued.

2. The method according to claim 1, characterized in that the predetermined criterion is a time span.

3. The method according to claim 2, characterized in that the determining of the amount for the yarn wound onto the take-up bobbin since the preceding yarn joinder comprises measuring the time elapsed since a restart of yarn winding after the preceding yarn joinder.

4. The method according to claim 1, characterized in that the predetermined criterion is a length of yarn and the determining of the amount for the yarn wound onto the take-up bobbin since the preceding yarn joinder comprises measuring the yarn length wound onto the take-up bobbin since a restart of yarn winding after the preceding yarn joinder.

5. The method according to one of the preceding claims, characterized in that the yarn interruption comprises performing a cutting of the yarn.

* * * * *